US006828916B2

(12) United States Patent
Rains et al.

(10) Patent No.: US 6,828,916 B2
(45) Date of Patent: Dec. 7, 2004

(54) TRUCK ASSEMBLY WITH INTERNALLY HOUSED EFFECT MODULES

(76) Inventors: Mark A. Rains, 4601 W. Seward Rd., Guthrie, OK (US) 73044; Scott Lee, 12800 Three Oaks, Jones, OK (US) 73049

( * ) Notice: Subject to any disclaimer, the term of this patent is extended or adjusted under 35 U.S.C. 154(b) by 47 days.

(21) Appl. No.: 10/143,231

(22) Filed: May 10, 2002

(65) Prior Publication Data

US 2002/0167415 A1 Nov. 14, 2002

Related U.S. Application Data

(60) Provisional application No. 60/290,215, filed on May 10, 2001.

(51) Int. Cl.[7] ..... G08B 21/00

(52) U.S. Cl. ..... 340/665; 340/691.1; 340/692; 340/815.4; 340/384.1

(58) Field of Search ..... 340/665, 686.1, 340/687, 689, 691.1, 692, 815.4, 815.45, 384.1, 384.6

(56) References Cited

U.S. PATENT DOCUMENTS

| | | | | |
|---|---|---|---|---|
| 4,336,573 A | | 6/1982 | Carter | |
| 4,817,974 A | | 4/1989 | Bergeron | |
| 4,954,805 A | | 9/1990 | Buyak | |
| 4,997,196 A | * | 3/1991 | Wood | 280/87.042 |
| 5,004,256 A | * | 4/1991 | Won | 280/87.042 |
| 5,067,058 A | | 11/1991 | Standley | |
| 5,119,277 A | * | 6/1992 | Copley et al. | 362/61 |
| 5,130,693 A | | 7/1992 | Gigandet | |
| 5,132,883 A | * | 7/1992 | La Lumandier | 362/81 |
| 5,292,141 A | * | 3/1994 | Ekedal et al. | 280/87.042 |
| 5,330,026 A | * | 7/1994 | Hsu et al. | 180/181 |
| 5,513,080 A | | 4/1996 | Magle et al. | |
| 6,050,357 A | * | 4/2000 | Staelin et al. | 180/65.1 |
| 6,530,581 B2 | * | 3/2003 | Lai | 280/11.203 |

FOREIGN PATENT DOCUMENTS

| | | | | |
|---|---|---|---|---|
| GB | 2381503 A | * | 7/2003 | A63C/17/26 |

* cited by examiner

*Primary Examiner*—Toan N. Pham
(74) *Attorney, Agent, or Firm*—Crowe & Dunlevy, P.C.

(57) ABSTRACT

The present invention provides a truck assembly for use on a skateboard. The truck assembly preferably includes a base block having a battery chamber and a circuit board cavity, a battery contained within the battery chamber, a circuit board housed inside the circuit board cavity, wherein the circuit board is in electrical communication with the battery, and an effect module that is operably connected to the circuit board to produce a selected effect.

20 Claims, 5 Drawing Sheets

TRUCK ASSEMBLY WITH INTERNALLY HOUSED EFFECT MODULES

RELATED APPLICATION

This application claims priority to Provisional Patent Application No. 60/290,215 filed May 10, 2001.

FIELD OF THE INVENTION

The present invention relates generally to an accessory for use with a skateboard. The invention more particularly relates to a truck assembly for use with a skateboard that internally houses electronics that are capable of producing audio-visual effects. Although the present application discloses the use of the present invention in conjunction with a skateboard, it will be understood that the present invention could also be used in connection with other devices, such as, for example, roller skates.

BACKGROUND OF THE INVENTION

The sport of skateboarding has recently experienced a rapid growth in popularity. People of all ages are enjoying the physical and mental rewards of the sport. Likewise, spectators around the world are drawn to the impressive displays of skill and daring in competitive skateboarding. As skateboarders become more aggressive with their maneuvers, the demands placed on skateboards and related equipment also increases. For example, skateboarders often "grind" the skateboard by sliding the skateboard along its lateral axis on a curb or rail.

When used in the context of skateboard design and manufacture, the term "truck" refers to a steering mechanism that typically includes an axle that is pivotally mounted to a base that is attachable to the underside of a skateboard. Over the years, a common design of a truck has evolved in which an axle pivots about a pivot arm that extends from the center portion of the axle. The remote end of the pivot arm is loosely fitted within a plastic cup mounted in the base, forming a ball-socket joint. Often, a number of thin plastic riser pads are positioned between the baseplate and the underside of the skateboard deck to raise the skateboard from the ground.

To hold the pivot arm within the plastic cup, a pair of doughnut-shaped grommets, usually made of rubber or urethane plastic of various hardnesses, are mounted on a substantially vertical "kingpin" fixed in the base on the side of the axle opposite the pivot arm. These grommets grasp a ring extending from the axle body opposite the pivot arm so that the axle is suspended between the ball-like joint and the grommets. The resistance to axle rotation is adjusted by increasing or decreasing the pressure on the grommets, which is accomplished by adjusting the tension on the kingpin.

To improve the overall safety of skateboarding, it is known in the prior art to include lighting devices on the skateboard. For example, U.S. Pat. No. 4,817,974 issued to R. L. Bergeron (Bergeron '974") teaches a lighting system mounted to the underside of a skateboard deck. The Bergeron '974 discloses a skateboard having upwardly exposed forward and rearward light brackets which are configured for quick release from, and attachment to, the skateboard nose and tail. Although effective as a means for illumination, the design taught by the Bergeron patent is deficient because the light brackets are exposed to contact with foreign objects (e.g. pavement, curbs, rails, etc.) during use.

Similarly, U.S. Pat. No. 5,513,080 issued to Magle et al. ("Magle '080") discloses an indirect lighting system for in-line skates and skateboards that optionally includes a switching means to provide a flashing effect. Similarly, U.S. Pat. No. 5,004,256 issued to Won ("Won '256") teaches an electronic device for generating sound or light. Like the Bergeron '974 patent, however, the systems taught by the Magle '080 and Won '256 patents are completely unprotected and vulnerable to damage during use.

U.S. Pat. No. 5,067,058 issued to Standley ("Standley '058") teaches a self-contained battery lamp that is partially housed in riser pads between the truck assembly baseplate and the underside of the skateboard deck. In this way, the battery lamp is partially protected from impact during use. To house the battery lamp, however, the riser pads must be about four times as thick as riser pads found in conventional truck assemblies. Increasing the thickness of the riser pads raises the skateboard's center of gravity, thereby significantly decreasing the overall stability and performance characteristics of the skateboard. Additionally, a portion of the self-contained battery lamp taught by Standley '058 extends beyond the riser pads and is housed in a polypropylene block. The position of the polypropylene block fails to protect the battery lamp from side-impact during use.

In view of the foregoing deficiencies in the prior art, there remains a continued need for a shielded audio-visual electronic device that does not adversely affect the performance of the skateboard. Other objects, advantages and features of the present invention will become clear from the following detailed description and drawings when read in conjunction with the appended claims.

SUMMARY OF THE INVENTION

The present invention provides a truck assembly for use on a skateboard. The truck assembly preferably includes a base block having a battery chamber and a circuit board cavity, a battery contained within the battery chamber, a circuit board housed inside the circuit board cavity, wherein the circuit board is in electrical communication with the battery, and an effect module that is operably connected to the circuit board to produce a selected effect.

DETAILED DESCRIPTION OF THE PREFERRED EMBODIMENT

Figure 1:
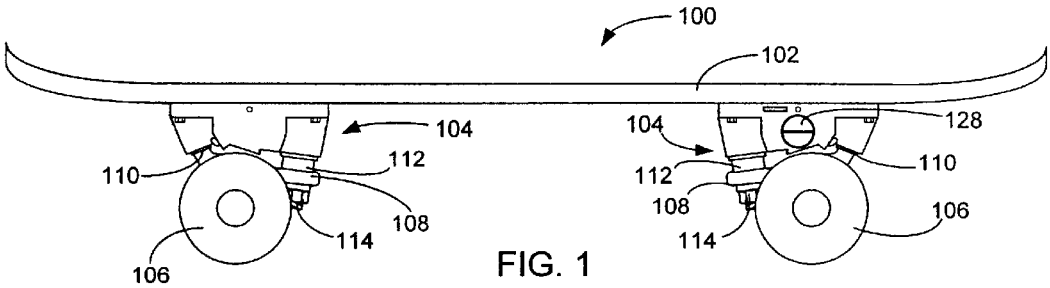
FIG. 1 is a right side elevational view of a skateboard constructed in accordance with a preferred embodiment of the present invention.

Referring to FIG. 1, shown therein is a side elevational view of a skateboard 100 constructed in accordance with a presently preferred embodiment of the present invention. The skateboard 100 includes a deck 102, a plurality of truck assemblies 104 and a plurality of wheels 106. The wheels 106 are mounted on truck axles 108 that are pivotally attached to the truck assemblies 104 at pivot cups 110. The resistance to the pivotal movement of the truck axles 108 is controlled by increasing or decreasing the pressure on rubber grommets 112 by adjusting the tension on a kingpin 114.

Figure 2:
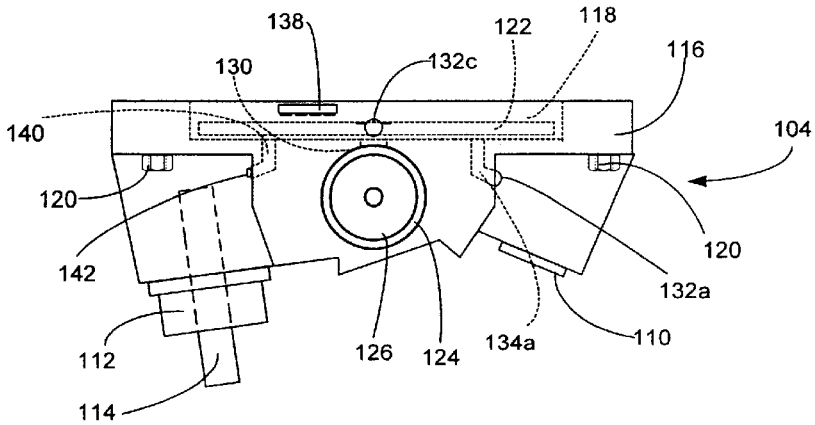
FIG. 2 is a left side elevational view of a truck assembly constructed in accordance with a preferred embodiment of the present invention.
Figure 3:
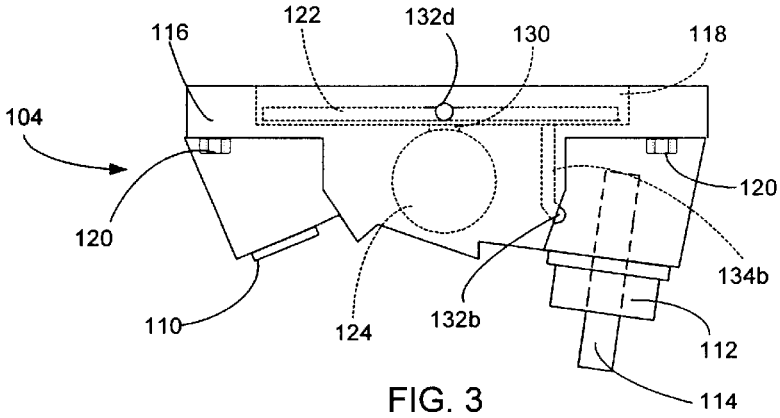
FIG. 3 is a side elevational view of a truck assembly constructed in accordance with a preferred embodiment of the present invention.
Figure 4:
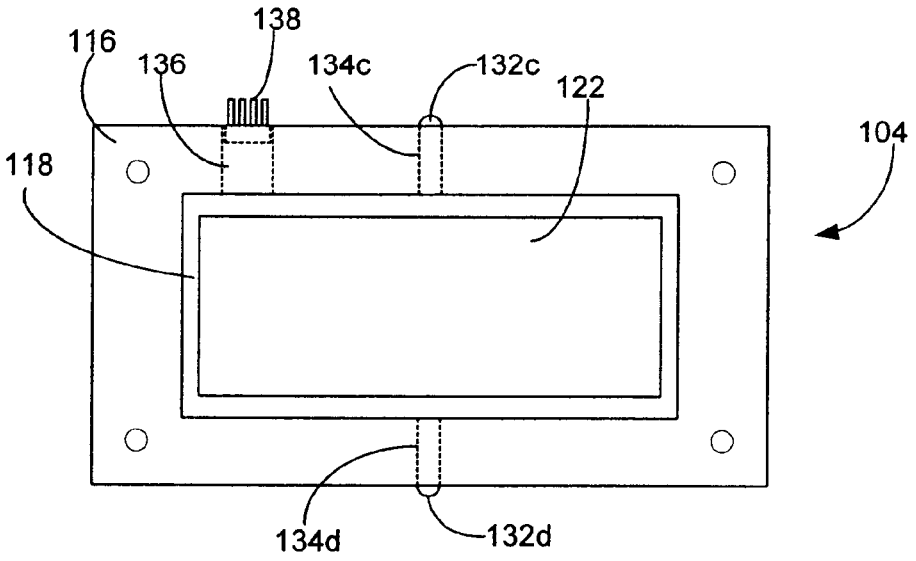
FIG. 4 is a bottom plan view of the truck assembly of FIG. 2.

Referring now to FIGS. 2, 3 and 4, shown therein are right and left side elevational and bottom plan views, respectively, of the truck assembly 104 constructed in accordance with a embodiment of the present invention. The truck assembly 104 includes a base block 116 that supports the kingpin 114 and the pivot cup 110. In this way, the base block 116 transfers the load placed on the deck 102 to the wheels 106. Preferably, the base block 116 is manufactured from an aluminum or titanium alloy, or other sturdy, lightweight material, such as injection molded plastic. The truck assembly 104 also includes a cavity 118 for housing the required components of one or more effect modules, as described below. The base block 116 is attached to the deck 102 preferably with truck assembly bolts 120.

In a first embodiment, the truck assembly 104 includes a variable flasher system 123 effect module and a battery chamber 124 suitable for retaining a battery 126. Preferably, the battery 126 is a rechargeable nickel cadmium ("ni-cad") battery having an approximate voltage in the range of 2–5 volts, most preferably about 3.5 volts. A battery cap 128 (not shown in FIG. 2) is used to retain the battery 126 within the battery chamber 124. Preferably, the battery cap 128 is threaded to enable screwing engagement with the battery chamber 124.

A circuit board 122 is secured within the cavity 118 of the base block 116 preferably with a shock resistant adhesive, such as thermoplastic or hot glue. The circuit board 122 supports many of the electronic components that are utilized by the present invention. A battery bore 130 provides a conduit for wires (not shown) that conduct electricity between the battery 126 and the circuit board 122. Unlike prior art designs, the placement of the battery 126 and circuit board 122 inside the truck assembly 104 protects these components from impact with foreign objects during use without adversely affecting the performance characteristics of the skateboard 100. The internally located battery 126 and circuit board 122 can be configured together, separately and in cooperation with other components such as effect modules to produce audio and visual effects, as described below.

In the first embodiment, a plurality of light emitting diodes (LEDs) 132 (separately designated as 132*a*, 132*b*, 132*c* and 132*d*) are operably connected to the circuit board 122. A first set of LEDs 132*a*, 132*b* are housed in LED bores 134*a* and 134*b*, respectively, that extend from the exterior of the base block 116 to the circuit board 122. As shown in FIGS. 2 and 3, the LEDs 132*a*, 132*b* are preferably positioned on opposite sides and opposite ends of the battery chamber 124. The LED bores 134*a*, 134*b* provide a conduit for the wiring necessary for operation of the LEDs 132*a*, 132*b*. As used herein, reference to a number of common elements without additional specification collectively denotes the group of components or modules. For example, reference to "LEDs 132" refers collectively to LEDs 132*a* and 132*b*.

The base block 116 also includes a connector bore 136 that houses a circuit header 138 and a potentiometer bore 140 that houses a potentiometer 142. The potentiometer 142 and circuit header 138 are retained within their respective bores in such a way that prohibits the introduction of foreign material into the battery chamber 124. Preferably, the LED bores 134*a*, 134*b* and potentiometer bore 140 are vertically oriented with respect to the circuit board 122. As such, the individual components can be installed into the base block 116 while connected to the circuit board 122.

The base block 116 can also include LEDs 132*c*, 132*d* that are located along the sides of the base block 116. LED bores 134*c*, 134*d* permit the passage of the necessary wiring between the LEDs 132*c*, 132*d* and the circuit board 122. Although four white LEDs 132 are presently preferred, it will be understood that the use of fewer or greater numbers of LEDs is within the scope of the present invention. It is also within the scope of the present invention to alter the color and placement of the LEDs 132 on the truck assembly 104. Additionally, the LEDs 132 may be configured for cooperative use with filters, lenses or shades that alter the emission of light from the LEDs 132.

Figure 5:
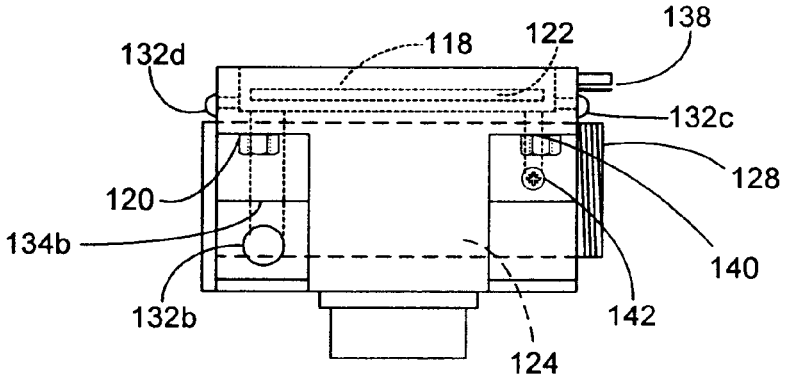
FIG. 5 is a rear elevational view of the truck assembly of FIG. 2.
Figure 6:
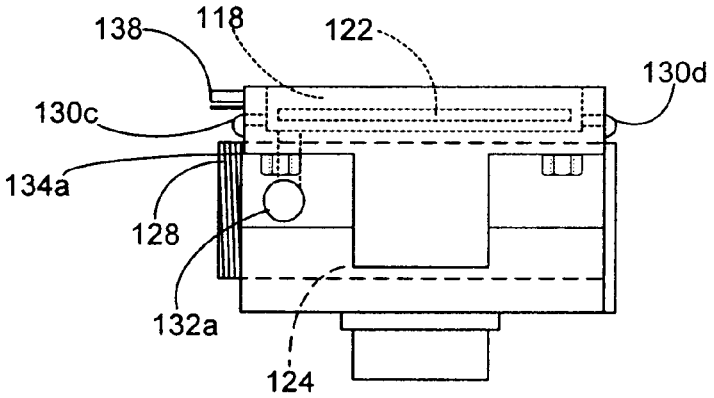
FIG. 6 is a front elevational view of the truck assembly of FIG. 2.

Turning to FIGS. 5 and 6, shown therein are front and rear elevational views of the truck assembly 104, respectively. FIGS. 5 and 6 illustrate the position of the various components and conduits on the base block 116. It will be understood to one of skill in the art that alternative placement of the circuit header 138 and potentiometer 142 are considered within the scope of the present invention. FIGS. 5 and 6 also illustrate the presently preferred screwing engagement of the battery cap 128 with the battery chamber 124. As shown, the battery cap 128 is partially screwed into the battery chamber 124.

Figure 7:
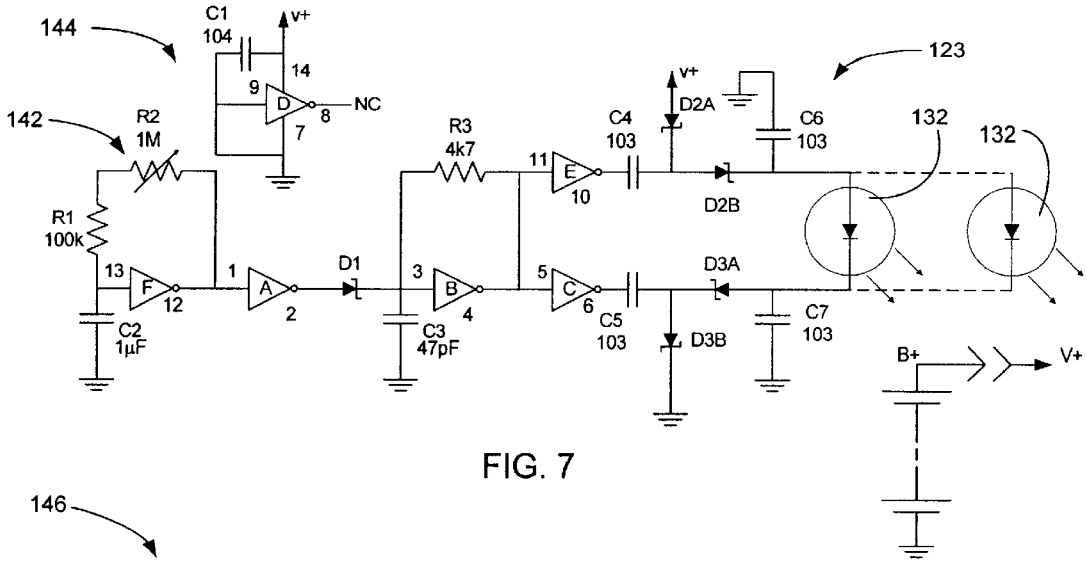
FIG. 7 is an electrical schematic diagram for a variable flasher circuit constructed in accordance with a preferred embodiment of the present invention.

Turning now to FIG. 7, shown therein is an electrical schematic diagram for an LED variable flasher circuit 144 to be incorporated in the circuit board 122. It will be understood that the flasher circuit 144 is merely an example of the type of circuit that can be employed with the present invention. For example, other circuits might provide in combination with, or apart from, the presently disclosed circuit, a controllable change in the intensity of the light emitted from a lightbulb or the control of fiber optics embedded within the deck 102 during manufacture.

The frequency of the flasher circuit 144, and hence the strobe rate of the LEDs 132, is controllably operated by the potentiometer 142. In the presently preferred embodiment, the flasher circuit 144 includes a 74AC14 Hex Inverting Schmitt Trigger integrated circuit that is configured as two astable multivibrators, one with a variable speed visual range switching rate as determined by capacitor C2 and resistor R2, and the other with a switching rate optimized for the voltage doubling efficiency as determined by capacitor C3 and resistor R3. The visual range multivibrator built around IC section F is buffered by IC section A which gates the power supply switching multivibrator built around IC section B via Schottky diode D1. The high rate of switching from section B is split two ways with each path buffered via capacitors C4 and C5 to Schottky diodes configured to step up the switched voltage pulses positively and negatively with these charges stored on capacitors C6 and C7. The LEDs 132 are connected to the positive and negative voltages on capacitors C6 and C7.

Figure 8:
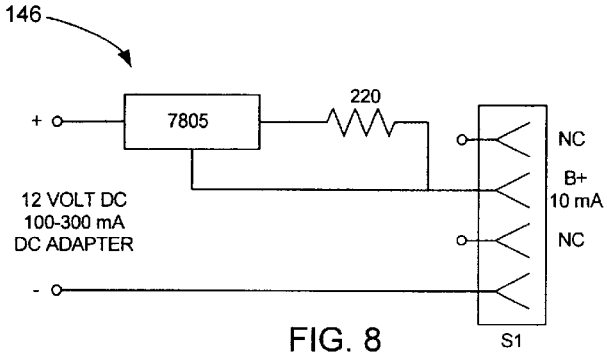
FIG. 8 is an electrical schematic diagram for a battery charger constructed for use with the circuit of FIG. 7.

FIG. 8 demonstrates a preferred charger circuit 146 to be employed by a charger for use with the rechargeable ni-cad battery 126. The charger circuit 146 utilizes a wall mounted DC power supply connected via a constant current source, e.g. a generator, solar panel or conventional power outlet. The 7805 Voltage Regulator Integrated Circuit and associated 220 ohm resistor preferably limit only 10 mA for charging the ni-cad battery 126.

Figure 10:
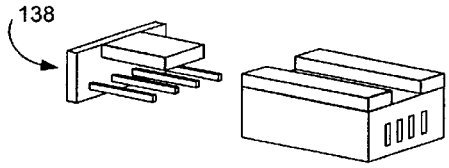
FIG. 10 is an isometric view of a power key and circuit header constructed in accordance with a preferred embodiment of the present invention.
Figure 9:
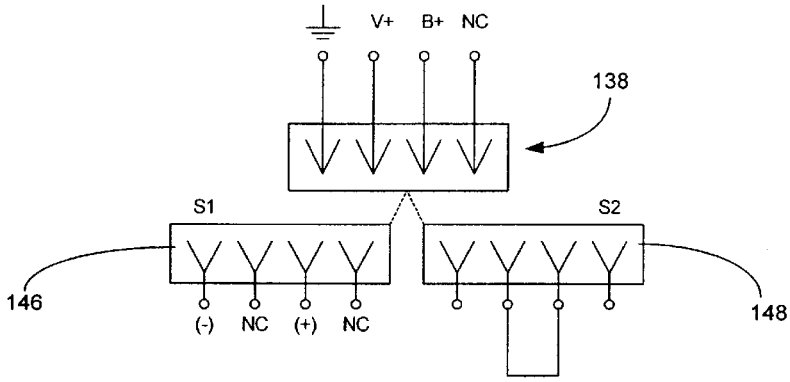
FIG. 9 is an electrical schematic diagram for a switch system for use with the circuit of FIG. 7.

Turning now to FIGS. 9 and 10, shown therein are a functional diagram and an isometric depiction, respectively, of the circuit header 138 and a "power key" 148. The circuit header 138 preferably includes four prongs, in which three of the four prongs are presently used to complete circuits. More specifically, the first prong is connected to ground, the second prong is connected to positive source of the flasher circuit 144 ("V+"), the third prong is connected to the positive source of the battery 126 ("B+") and the fourth prong is not connected ("NC").

In a first position ("S1"), a four socket receptacle of the battery charger circuit 146 is connected to the circuit header 138. In the S1 position, the positive and negative outputs from the charger circuit 146 are connected to the positive side of the battery 126 and the ground wire, respectively. When so connected, the battery 126 is charged by the charger circuit 146. In the S2 position, the power key 148, which includes a jumper between the middle two pin receptacles, is attached to the circuit header 138. As such, when connected, the positive side of the battery 126 is connected to the positive voltage side of the flasher circuit 144, thereby powering the LEDs 132. The power key 148 can be configured to be stored in a non-operational position on the circuit header 138 when not in use. It will be understood to those skilled in the art that alternative switching and controlling means are encompassed by the present invention. Such additional means include single "on/off" switches and remotely controlled switches.

Figure 11:
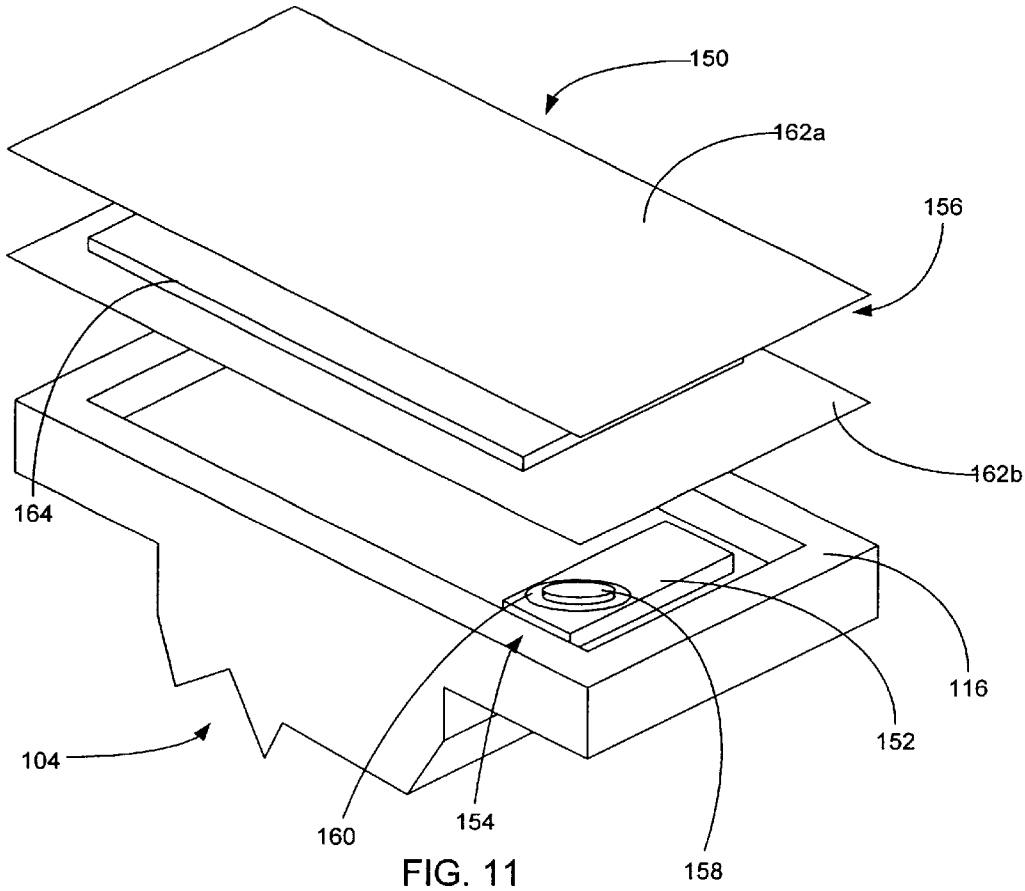
FIG. 11 is an isometric view of a truck assembly and force modulated pitch system constructed in accordance with a preferred embodiment of the present invention.
Figure 12:
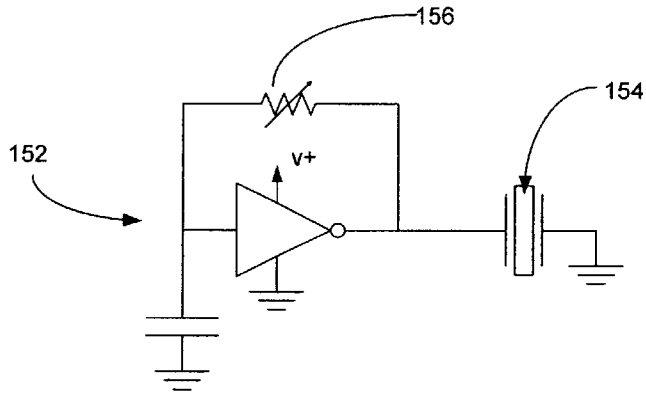
FIG. 12 is an electrical schematic diagram of the force modulated pitch system of FIG. 11.

In a second embodiment of the present invention, the truck assembly 104 includes a force modulated pitch system 150 effect module. As shown in FIGS. 11 and 12, the force modulated pitch system 150 includes a sounder circuit 152, a piezo sounder 154 and a resistor sandwich 156. The piezo sounder 154 is preferably configured as a piezo bender 158 mounted on a vibration plate 160. A presently preferred piezo sounder 154 is commercially available from Projects Unlimited, Inc. under part number AB4406B. In the presently preferred embodiment, the piezo sounder 154 is operably connected to the battery 126, which is housed in the battery chamber 124 as described above. Although a wide variety of components can be successfully used, the sounder circuit 152 can be configured as a multivibrator circuit that employs a hex inverting Schmitt trigger, as described above.

The resistor sandwich 156 includes a top copper clad 162*a*, a bottom copper clad 162*b* and a core layer of conductive foam 164. The resistance of the conductive foam 164 varies in response to force exerted by the top and bottom copper clads 162*a*, 162*b*. In a particularly preferred embodiment, the conductive foam 164 is crosslinked polyethylene foam that is commercially available from 3 M under the Velostat® trademark. It will be understood that other types of force-affected variable resistors can also be successfully employed and are encompassed within the scope of the present invention.

The resistor sandwich is preferably mounted between the truck assembly 104 and the deck 102 of the skateboard 100 and configured with the time-constant components of the sounder circuit 152. As the conductive foam 164 compresses and expands, the resistivity of the resistor sandwich 156 decreases and increases, respectively. As such, the pitch of the tone produced by the piezo sounder 154 varies in response to the application of force to the resistor sandwich 156.

Figure 13:
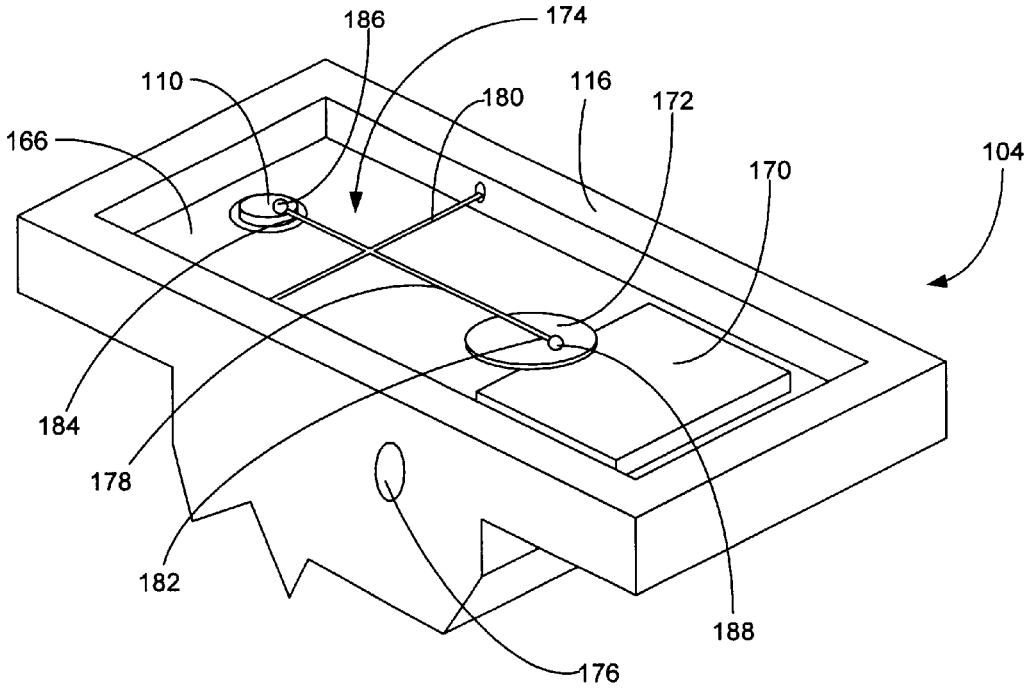
FIG. 13 is an isometric view of a truck assembly and a piezo electric LED system constructed in accordance with a preferred embodiment of the present invention.
Figure 14:
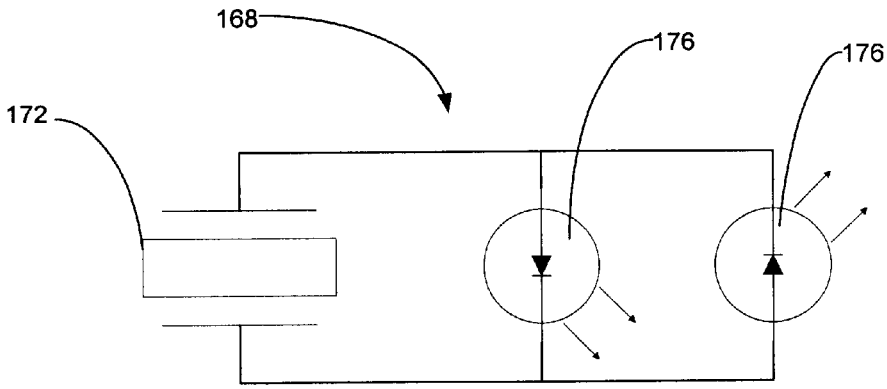
FIG. 14 is an electrical schematic diagram of the piezo electric LED system of FIG. 13.

In a third embodiment of the present invention, the base block 116 includes a recess 166 that houses a piezo electric LED system 168 effect module, as shown in FIGS. 13 and 14. Preferably, the piezo electric LED system 168 includes a circuit board 170, a piezo bender 172 and a hammer assembly 174, which combine to generate a voltage sufficient to stimulate a plurality of LEDs 176. To permit deflection, the piezo bender 172 is soldered at one edge to the circuit board 170. The LEDs 176 are electrically connected to the piezo bender 172 via the circuit board 170. The layers of the piezo bender 172 may be configured in series or parallel.

The hammer assembly 174 includes a lever 178 that pivots about a hammer axle 180. The lever 178 includes a first end 182 adjacent the piezo bender 172 and a second end 184 adjacent the pivot cup 110. The hammer axle 180 extends laterally across the recess 166 and is configured for rotation about its longitudinal axis. Spherical weights 186, 188 are used as counterbalances to keep the second end 184 of the lever 178 in contact with the underside of the pivot cup 110 in the absence externally applied force. It will be understood that alternative hammer mechanisms are also encompassed within the scope of the present invention. For example, the use of counterbalances can be replaced with a single lever that is pre-loaded in position adjacent the pivot cup 110.

During use, vertical force applied to the wheels 106 of the skateboard 100 is translated through the truck axle 108 to the kingpin 114 and pivot cup 110. In turn, mechanical energy is transmitted through the pivot cup 110, causing the lever 178 to rock up and down about the hammer axle 180. As the lever 178 rocks, the first end 182 of the lever 178 hammers the piezo bender 172, thereby generating a voltage which is passed to the circuit board 170. As such, the LEDs 176 "blink" as mechanical force is translated from the wheels 106 to the truck assembly 104.

It will be understood that multiple effect modules can be employed in a single truck assembly 104. For example, the truck assembly 104 can include a number of LEDs 132 that are controlled by the flasher circuit 144 in conjunction with the force modulated pitch system 150. As another example, the truck assembly 104 can include the force modulated pitch system 150 in conjunction with the piezo electric LED system 168. Other combinations and configurations of the foregoing effects are also encompassed with the scope of the present invention.

It is clear that the present invention is well adapted to carry out its objectives and attain the ends and advantages mentioned above. While presently preferred embodiments of the invention have been described in varying detail for the purposes of disclosure, it will be understood that additional embodiments incorporating the present invention exist and are encompassed within the spirit of the invention disclosed and as defined in the above text, in the accompanying drawings and in the appended claims.

It is claimed:

1. A truck assembly for use on a skateboard, the truck assembly comprising:

a base block having a battery chamber and a circuit board cavity;

a truck axle connected to the base block;

wheels attached to the truck axle, wherein the wheels protect the base block from impact;

a battery contained within the battery chamber;

a circuit board housed inside the circuit board cavity, wherein the circuit board is in electrical communication with the battery; and an effect module that is operably connected to the circuit board to produce a selected effect.

2. The truck assembly of claim 1, wherein the effect module is a variable flasher system.

3. The truck assembly of claim 2, wherein the variable flasher system has a strobe rate, and wherein the variable flasher system comprises:

at least one light emitting diode;

a potentiometer, wherein the potentiometer controls the strobe rate of the variable flasher system.

4. The truck assembly of claim 1, wherein the effect module is a force modulated pitch system.

5. The truck assembly of claim 4, wherein the force modulated pitch system includes a piezo sounder that is operably connected to the circuit board and wherein the pitch of the sound produced by the piezo sounder varies in response to a force-affected variable resistor.

6. The truck assembly of claim 5, wherein the force-affected variable resistor is a resistor sandwich operably connected to the circuit board, the resistor sandwich comprising:

a top conductive clad;

a bottom conductive clad; and a layer of conductive foam retained between the top and bottom conductive clads.

7. The truck assembly of claim 1, further comprising a circuit header operably attached to the circuit board.

8. The truck assembly of claim 7, wherein the battery is rechargeable and wherein a battery charger circuit can be connected to the circuit header to charge the battery.

9. The truck assembly of claim 8, wherein a power key is selectively connected to the circuit header to switch power to the circuit board.

10. A truck assembly for use on a skateboard, the truck assembly comprising:

a base block, wherein the base block includes a pivot cup and a recess;

a truck axle connected to the base block;

wheels attached to the truck axle, wherein the wheels protect the base block from impact; and a piezo electric LED system, wherein the piezo electric LED system comprises:

a circuit board housed inside the recess;

a piezo bender connected to the circuit board;

at least one LED connected to the circuit board; and a lever that is configured to strike the piezo bender in response to force transmitted through the pivot cup.

11. The truck assembly of claim 10, wherein the lever is pivotally mounted on an orthogonally oriented hammer axle.

12. The truck assembly of claim 11, wherein the lever further comprises a plurality of counterbalances that affect the movement of the pivotal movement of the lever.

13. A truck assembly for use on a skateboard, the truck assembly comprising:

a base block having a battery chamber and a cavity;

a truck axle connected to the base block;

wheels attached to the truck axle, wherein the wheels protect the base block from impact;

a battery contained within the battery chamber;

a circuit board housed inside the cavity, wherein the circuit board is in electrical communication with the battery;

a force modulated pitch system operably connected to the circuit board; and a variable flasher system operably connected to the circuit board.

14. The truck assembly of claim 13, wherein the variable flasher system has a strobe rate, and wherein the variable flasher system comprises:

at least one light emitting diode;

a potentiometer, wherein the potentiometer controls the strobe rate of the variable flasher system.

15. The truck assembly of claim 13, wherein the force modulated pitch system includes a piezo sounder that is operably connected to the circuit board and wherein the pitch of the sound produced by the piezo sounder varies in response to a force-affected variable resistor.

16. The truck assembly of claim 15, wherein the force-affected variable resistor is a resistor sandwich operably connected to the circuit board, the resistor sandwich comprising:

a top conductive clad;

a bottom conductive clad; and a layer of conductive foam retained between the top and bottom conductive clads.

17. A truck assembly for use on a skateboard, the truck assembly comprising:

a base block having a battery chamber and a cavity;

a truck axle connected to the base block;

wheels attached to the truck axle, wherein the wheels protect the base block from impact;

a pivot cup housed in the base block;

a battery contained within the battery chamber;

a circuit board housed inside the cavity, wherein the circuit board is in electrical communication with the battery;

a force modulated pitch system operably connected to the circuit board; and an piezo electric LED system connected to the circuit board.

18. The truck assembly of claim 17, wherein the force modulated pitch system includes a piezo sounder that is operably connected to the circuit board and wherein the pitch of the sound produced by the piezo sounder varies in response to a force-affected variable resistor.

19. The truck assembly of claim 18, wherein the force-affected variable resistor is a resistor sandwich operably connected to the circuit board, the resistor sandwich comprising:

a top conductive clad;

a bottom conductive clad; and a layer of conductive foam retained between the top and bottom conductive clads.

20. The truck assembly of claim 17, wherein the piezo electric LED system comprises:

a circuit board housed inside the recess;

a piezo bender connected to the circuit board;

at least one LED connected to the circuit board; and a lever that is configured to strike the piezo bender in response to force transmitted through the pivot cup.

* * * * *